US007855693B2

(12) United States Patent
Martek et al.

(10) Patent No.: US 7,855,693 B2
(45) Date of Patent: Dec. 21, 2010

(54) WIDE BAND BICONICAL ANTENNA WITH A HELICAL FEED SYSTEM

(75) Inventors: Gary A. Martek, Blythewood, SC (US); Leon Fulmer, Prosperity, SC (US); John M. Maynard, Columbia, SC (US); Henry R. Jarman, Gadsden, SC (US)

(73) Assignee: Shakespeare Company, LLC, Columbia, SC (US)

( * ) Notice: Subject to any disclaimer, the term of this patent is extended or adjusted under 35 U.S.C. 154(b) by 725 days.

(21) Appl. No.: 11/890,257

(22) Filed: Aug. 3, 2007

(65) Prior Publication Data

US 2009/0033578 A1 Feb. 5, 2009

(51) Int. Cl.
*H01Q 13/00* (2006.01)

(52) U.S. Cl. ..... 343/773; 343/895; 343/791

(58) Field of Classification Search ..... 343/895, 343/791, 773, 774

See application file for complete search history.

(56) References Cited

U.S. PATENT DOCUMENTS

| | | | | |
|---|---|---|---|---|
| 4,527,163 | A | 7/1985 | Stanton | 343/700 MS |
| 5,534,880 | A * | 7/1996 | Button et al. | 343/774 |
| 5,668,510 | A * | 9/1997 | Humpherys | 333/127 |
| 6,259,416 | B1 | 7/2001 | Qi et al. | 343/767 |
| 6,377,227 | B1 | 4/2002 | Zhu et al. | 343/795 |
| 6,525,694 | B2 | 2/2003 | Jiang et al. | 343/742 |
| 6,879,296 | B2 | 4/2005 | Jiang et al. | 343/767 |
| 7,050,014 | B1 | 5/2006 | Chen et al. | 343/795 |
| 2006/0001578 | A1 | 1/2006 | Holmes et al. | 343/702 |
| 2006/0017644 | A1 * | 1/2006 | Martek | 343/795 |
| 2008/0024374 | A1 | 1/2008 | Cornwell | 343/703 |

FOREIGN PATENT DOCUMENTS

| | | |
|---|---|---|
| CA | 2 270 302 A1 | 4/1999 |
| CA | 2 307 515 A1 | 4/2000 |

* cited by examiner

*Primary Examiner*—Douglas W Owens
*Assistant Examiner*—Dieu Hien T Duong
(74) *Attorney, Agent, or Firm*—Lawrence J. Shurupoff

(57) ABSTRACT

A wide band biconical antenna with a helical feed system comprises a printed circuit board (PCB) that maintains a plurality of antenna elements having an entry conic and a termination conic arranged about a common axis. Each of the antenna elements receive a signal from a signal splitter via respective feed lines that each have the same physical length. In addition, the antenna system includes a matching system disposed within the ground plane formed by the entry conic of each of the antenna elements. The antenna elements are retained within retention sections that maintain helical support channels that allow the feed lines to be arranged in a helical manner about the antenna elements.

15 Claims, 15 Drawing Sheets

WIDE BAND BICONICAL ANTENNA WITH A HELICAL FEED SYSTEM

TECHNICAL FIELD

The present invention relates generally to wide band antenna arrays. Particularly, the present invention relates to a wide band antenna array that is comprised of biconical antenna elements that are formed on a printed circuit board. More particularly, the present invention relates to a wide band biconical antenna array that utilizes a plurality of antenna elements that share a common axis. Specifically, the present invention is directed to a wide band biconical antenna array that receives signals to be transmitted from a helical feed system.

BACKGROUND ART

Phased array antenna systems typically utilize narrow band antenna elements that are independently excited by a phased feed system. The phased feed system provides a phase coherent distribution of power, whereby the supplied signal power is delivered to each of the antenna elements in phase. By delivering the power to each of the antenna elements in phase, additive reinforcement of the power of each of the transmitted signals is achieved which is needed for additive antenna gain multiplication. As such, phased array antennas create a directional energy pattern that is useful for various applications, such as radar systems. Thus, as long as the phased feed system provides a phase coherent distribution of power to each of the antenna elements of the array, the power of each of the signals transmitted by the antenna elements is summed together, increasing the signal strength of the antenna in a specific direction.

To provide such phase coherent power distribution to the antenna elements, the coaxial feed lines, or waveguides, comprising the phased feed system are required to be physically cut to a length that is a multiple of the wavelength of the signal to be transmitted. Unfortunately with such a system, as the operating or transmitting frequency of the antenna system is changed, the antenna elements no longer transmit phase coherent signals. As a result, the antenna array transmits signals that are skewed or which points in an undesirable direction. To restore the phase coherent operation to the antenna elements, the feed lines or waveguides are required to be re-cut to a new length corresponding to the wavelength of the new operating frequency, such a step is cumbersome, time consuming and unwanted.

Therefore, there is a need for a wide band biconical antenna that utilizes multiple antenna elements that are aligned about a common axis. In addition, there is a need in the art for a wide band biconical antenna that provides multiple antenna elements that are coupled to a signal source by feed lines that each have the same physical length. Furthermore, there is a need for a wide band biconical antenna that transmits a phase coherent signal independent of the excitation signal frequency. And there is a need for a wide band biconical antenna that provides a helical feed system that minimizes far-field radiation pattern interference during multiple antenna element excitation. Still yet, there is a need for a wide band biconical antenna that provides a helical feed system that maintains a translucent aperture with minimum blockage to the field of view of the antenna.

SUMMARY OF THE INVENTION

It is thus an object of the present invention to provide wide band biconical antennas with a helical feed system.

Another aspect of the present invention is to provide an antenna for transmitting a signal from a signal source comprising at least two helical retention sections and at least two coaxial antenna element sections configured to be respectively disposed within the helical retention sections.

These and other objects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
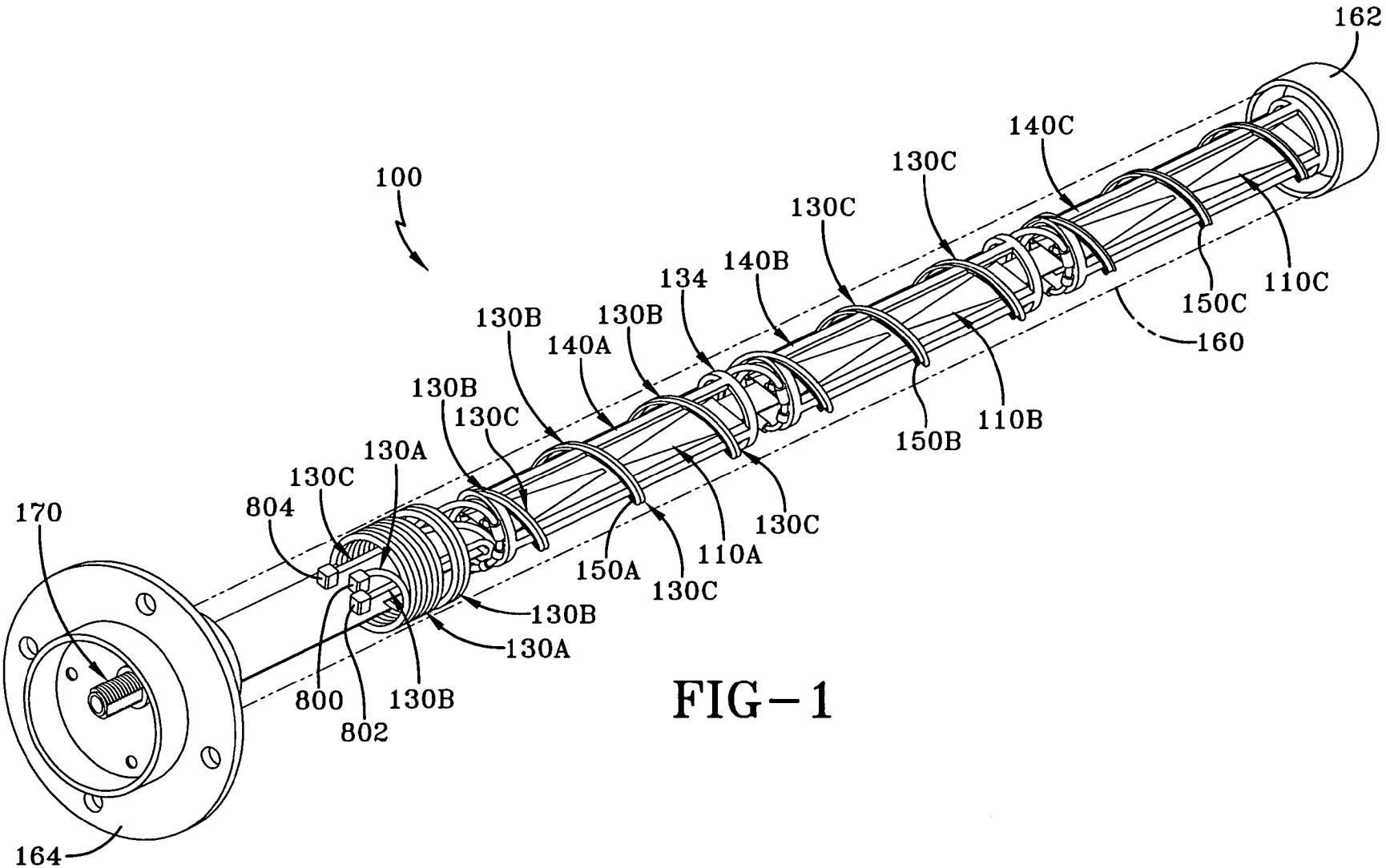
FIG. 1 is a perspective view of a wide band biconical antenna system including a plurality of antenna element sections mounted within respective retention sections in accordance with the concepts of the present invention.

A wide band biconical antenna system is generally referred to by the numeral 100, as shown in FIG. 1 of the drawings. The biconical antenna system 100 is configured to include a plurality of coaxial biconical antenna elements 110A, 110B, and 110C that are disposed upon a printed circuit board (PCB) 118. It will be appreciated that each antenna element 110 has an alphabetic suffix (A,B,C) associated therewith, and that each component associated with a particular antenna element has a corresponding suffix. Continuing, each of the antenna elements 110A, 110B, 110C are coupled to a signal splitter 120, shown in FIG. 4, via respective coaxial feed lines 130A, 130B, and 130C. The coaxial feed lines 130A-C, may be formed from any suitable coaxial cable, such as conformable coaxial cable, and are supported about the antenna elements 110A-C via a helical feed system 134.

Figure 15:
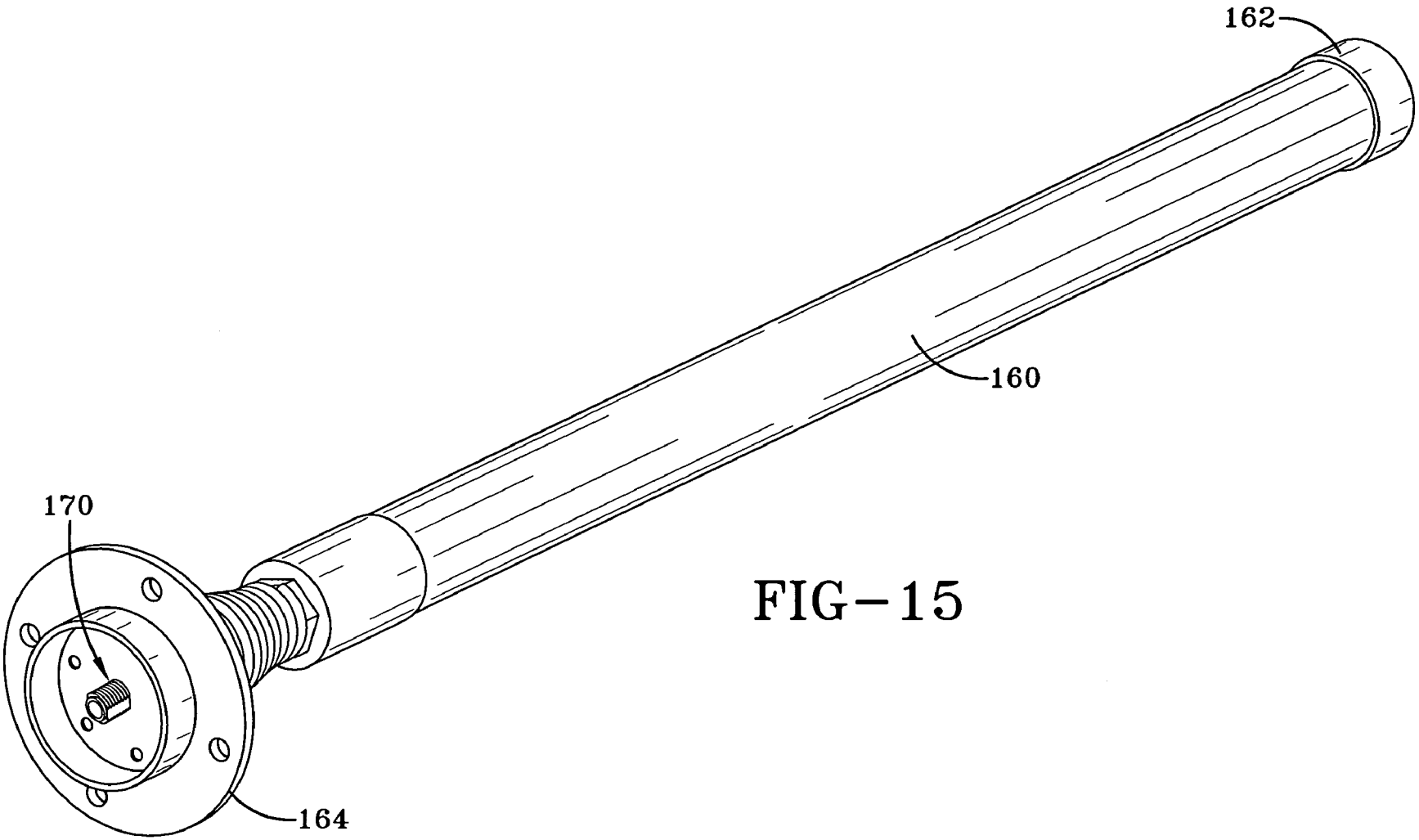
FIG. 15 is a perspective view of a radome and cap used to enclose the biconical antenna system in accordance with the concepts of the present invention.

The helical feed system 134 comprises retention sections 140A, 140B, and 140C that retain the antenna elements 110A, 110B, 110C therein. Disposed about the outer periphery of each retention section 140 is a corresponding helical support channel 150 which are configured to retain the feed lines 130 in a manner to be discussed. The antenna system 100 may be enclosed by a radome 160 and/or a cap 162, as shown in FIGS. 1 and 15. Moreover, the axial arrangement of the antenna elements 110A, 110B, and 110C allow the antenna system 100 to be configured as a whip-type antenna having a narrow profile, that may be mounted to a vehicle or to any desired fixture via a mounting flange 164.

During operation of the biconical antenna system 100 the signal splitter 120 receives an RF signal to be transmitted via an RF (radio frequency) input connector 170. Such an RF signal may be supplied from any suitable signal generation device, such as an RF transmitter for example. As will be discussed, the signal is carried from the signal generation device by a transmission line that is fed to the input connector 170 that protrudes through an opening in the flange 164 and that is connected to the splitter 120. The signal splitter 120 substantially equally divides the power associated with the signal and supplies it to each of the antenna elements 110A-C, via the helically arranged feed lines 130A-C. The feed lines 130 are configured to be the same physical length, so that the signals delivered by the signal splitter 120 to each of the respective antenna elements 110 have an equal time delay, allowing the signals transmitted by each of the antenna elements 110A-C to be phase coherent. That is, providing signals to the antenna elements 110A-C with substantially equal time delay allows the signals radiating from each of the antenna elements to be additively reinforced, thus allowing additive gain multiplication of the radiated signals to occur. In addition, the helical support channels 150A and 150B, allows the feed lines 130B and 130C to be arranged in a helical manner, so that the coherent signals generated by the antenna elements 110A-C are minimally attenuated.

Figure 2:
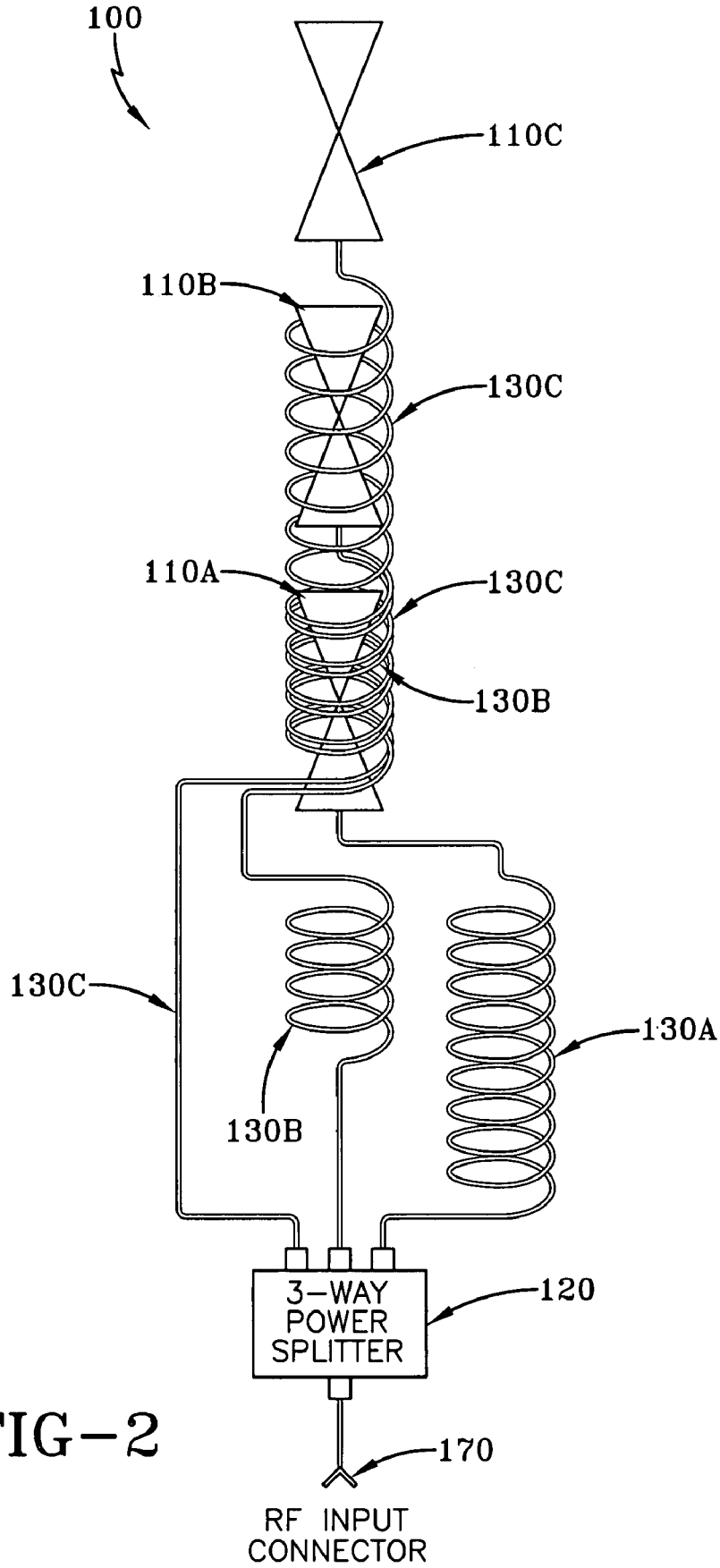
FIG. 2 is a schematic view of the wide band biconical antenna system in accordance with the concepts of the present invention.

FIG. 2 schematically shows the structural interconnection and functional relationship among the antenna elements 110A-C, the feed lines 130A-C, the power splitter 120, and the RF (radio frequency) input connector 170. As such, it is apparent that the feed lines 130 A-C are coupled between the signal splitter 120 and each of the respective antenna elements 110A-C. And that feed lines 130B and 130C are helically oriented about antenna element 110A, while feed line 130C is helically oriented about antenna element 110B.

Figure 3:
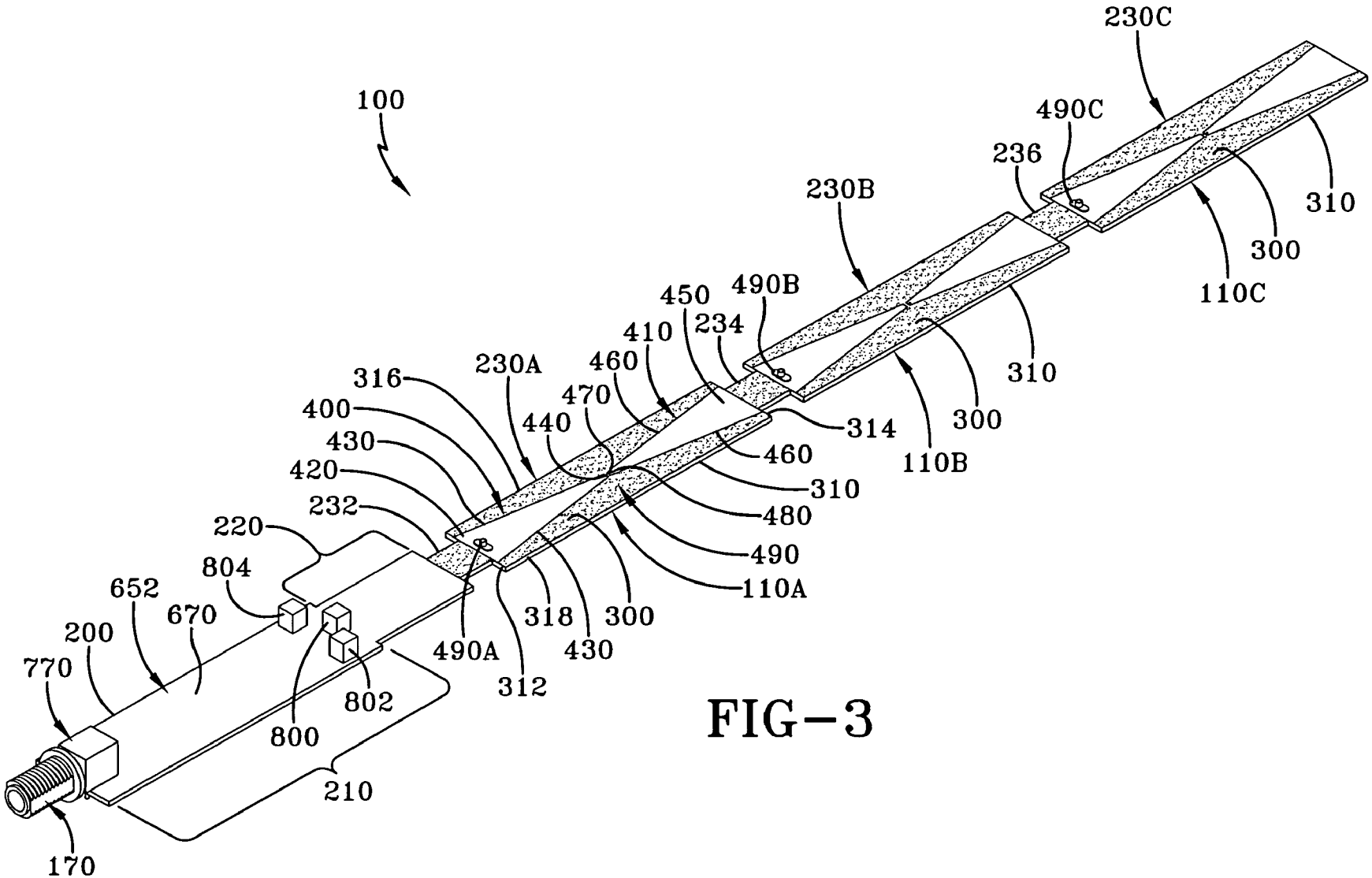
FIG. 3 is a perspective view of the biconical antenna system having a conic side that includes a plurality of entry and termination conics arranged about a common axis in accordance with the concepts of the present invention.

Shown in FIG. 3, as well as in several of the other FIGS., the antenna elements 110A, 110B, and 110C, as well as other components of the antenna system 100, are maintained in a two-dimensional configuration upon the printed circuit board (PCB) 118. Specifically, the PCB 118 includes a non-conductive substrate 200 that includes the various components of the antenna 100 to be discussed. The material forming the substrate 200 may comprise any non-conductive material, such as a glass cloth laminate with an epoxy resin binder, commonly referred to by "FR4" circuit board substrate material. In addition, the substrate 200 may be formed from polytetrafluoroethylene (PTFE) "Teflon" that is laminated upon the above "FR4" circuit board substrate material.

Continuing, the circuit board 118 comprising the antenna 100 is divided into a plurality of sections that include a splitter section 210 and a support section 220, which are in series with a plurality of antenna element sections 230A, 230B and 230C. It may also be said that the sections 210, 220 and 230 laterally extend from their respective adjacent sections. Spacing sections 232, 234, and 236 serve to isolate the various sections of the antenna 100 from each other. Specifically, the antenna element sections 230A-C are configured to maintain respective antenna elements 110A, 110B, and 110C, which are separated by spacing sections 234 and 236. While the splitter section 210 and the support section 220 are separated from the antenna section 230A by the spacing section 232. Moreover, it should be appreciated that while the sections 210, 220, 230A-C, 232, 234, and 236 are shown as being generally rectangular in shape, such should not be limiting, as any desired 2-dimensional shape may be utilized.

Figure 4:
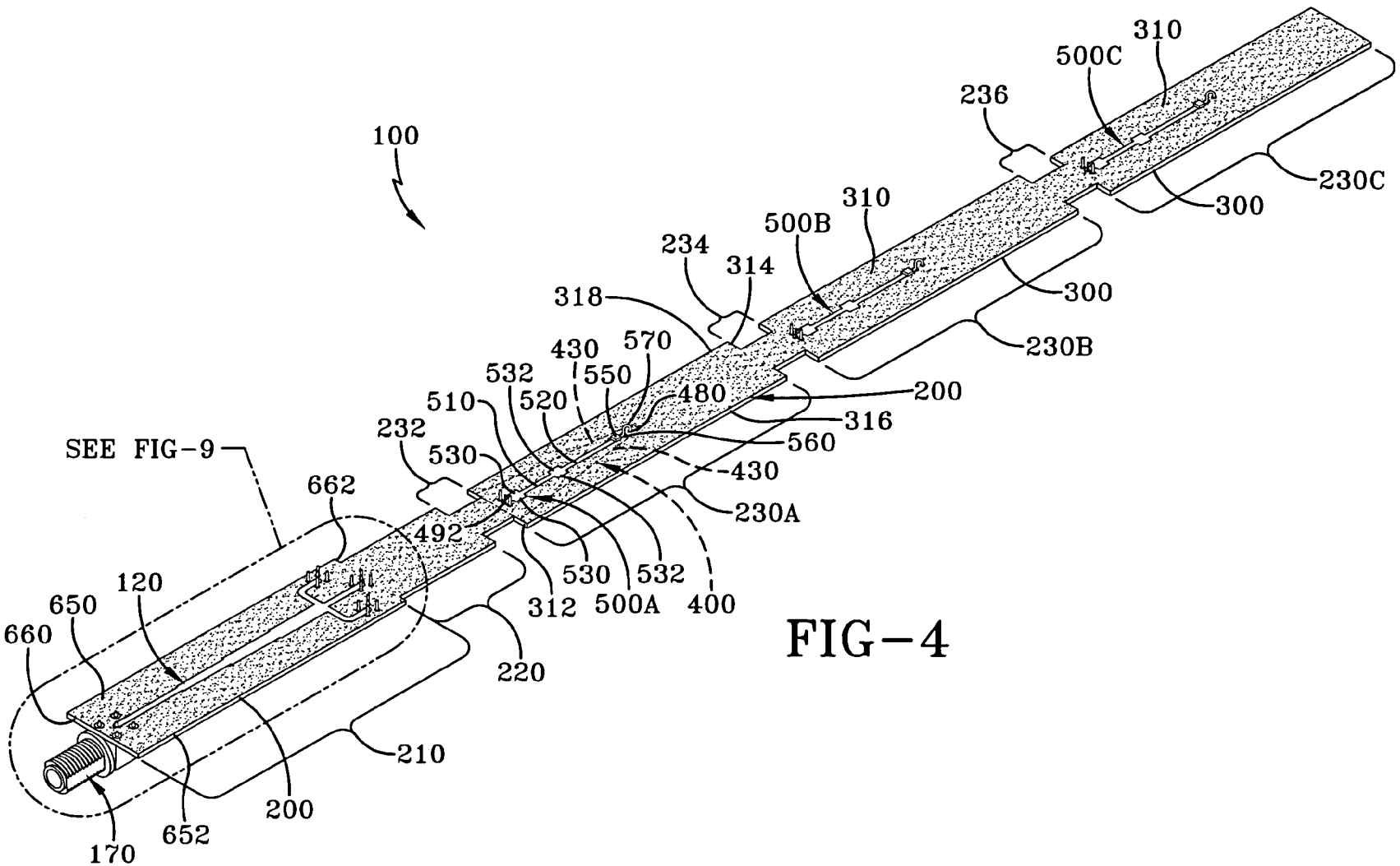
FIG. 4 is a perspective view of the biconical antenna system having a transmission side that includes a plurality of transmission lines arranged about a common axis in accordance with the concepts of the present invention.

The antenna element sections 230A, 230B, and 230C maintain a planar conic side 300, which is opposite a planar transmission side 310, shown more clearly in FIGS. 3 and 4. Continuing, the conic side 300 and the transmission side 310 of the antenna element section 230A maintain a connector end 312 that is opposite a distal end 314, whereby the ends 312 and 314 are separated by edges 316 and 318. Because the planar conic side 300 and the transmission side 310 extend along the entire length of the antenna element sections 230A-C, only the components associated with the antenna element section 230A will be set forth in the discussion below. In other words, the following discussion of section 230A and its components are applicable to sections 230B and 230C and their respective components.

Figure 5:
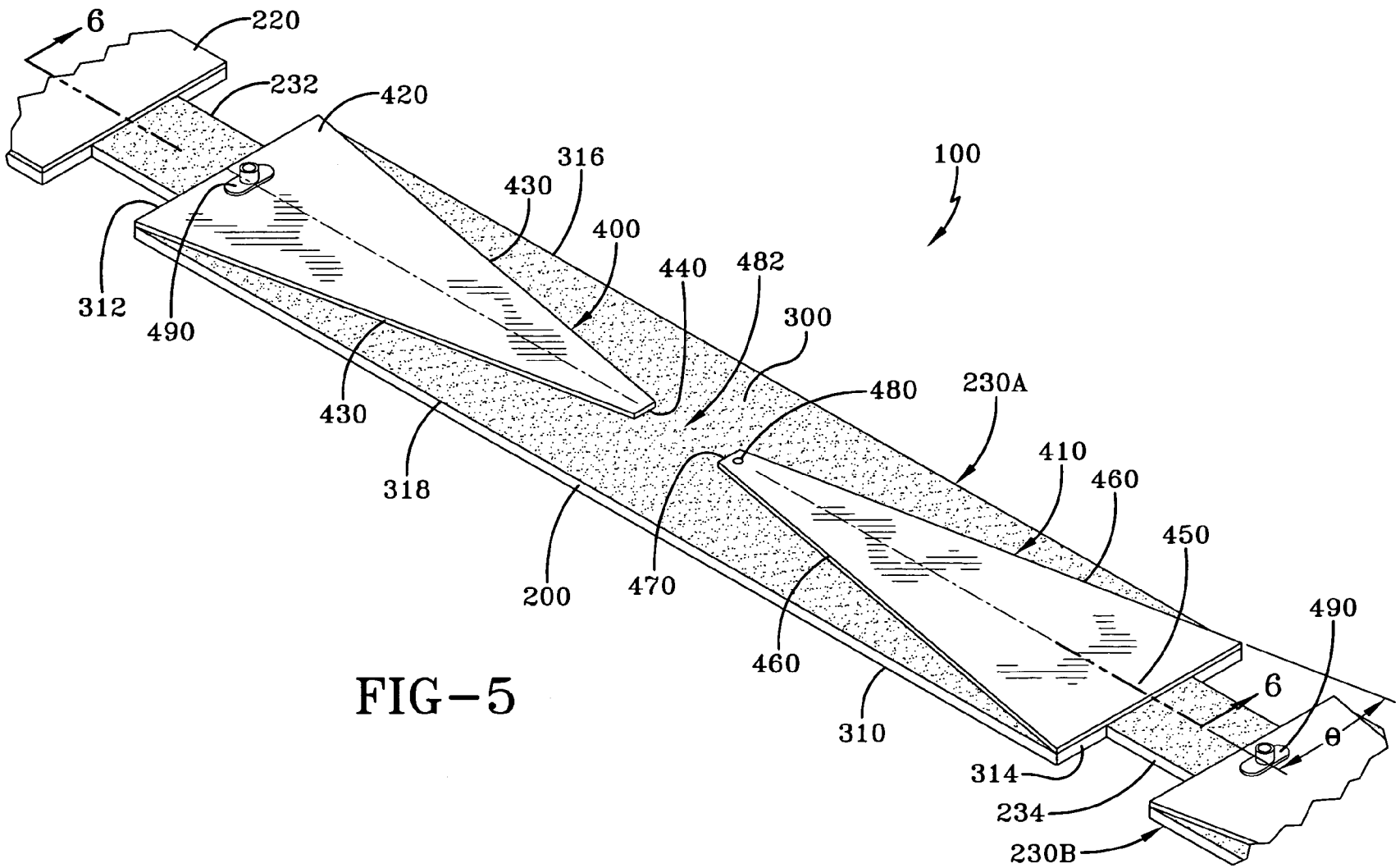
FIG. 5 is a perspective view of one pair of entry and termination conics maintained by the biconical antenna system in accordance with the concepts of the present invention.

As best seen in FIG. 5, the conic side 300 of the antenna element section 230A has an entry conic designated generally by the numeral 400 and a termination conic designated generally by the numeral 410. The entry conic and termination conics 400,410 are axially aligned with one another and are formed as a layer of metallized a conductive material that is disposed upon the substrate 200. The metallized material may comprise aluminum, tin, copper or any other appropriate conductive material that adheres to or is otherwise secured to the surface of the substrate 200. Although any thickness of metallized material can be used, it is believed that a thickness of about 0.0014 inches to 0.0028 inches or 1.4 to 2.8 thousandths of an inch is optimal. And a substrate 200 thickness of 30 to 60 thousandths of an inch is optimal.

The entry conic 400 has an entry base 420, which is disposed proximally adjacent to the connector end 312. Extending from the entry base 420 are a pair of entry sides 430, which angularly extend inward toward each other, terminating at a entry vertex 440. The entry vertex 440 is disposed at about a mid-point lengthwise and widthwise of the substrate 200 of the antenna element section 230A.

The termination conic 410, which is formed in the same manner as the entry conic 400, provides a termination base 450 proximally adjacent to the distal end 314. A pair of termination sides 460 extend from the termination base 450 and angularly extend inward toward each other terminating at a termination vertex 470. The termination vertex 470 is also disposed at about a mid-point lengthwise and widthwise of the substrate 200 of the antenna element section 230A. Disposed at a point proximate the termination vertex 470 is a conic aperture 480. The conic aperture 480 extends through the substrate 200 and the metallized termination conic 410. Furthermore, the termination vertex 470 and the entry vertex 440, although closely or adjacently disposed to one another, are not in contact with one another and, as such, form a vertex gap 482 therebetween.

Both the entry conic and the termination conics 400,410 are triangle shaped, as such shape has been found to provide the operating characteristics of a true conic while still providing the operating characteristics desired for the antenna 100. Moreover, the triangular shapes of the conics 400 and 410, provide a half-angle of 9° plus or minus 2°.

Figure 6A:
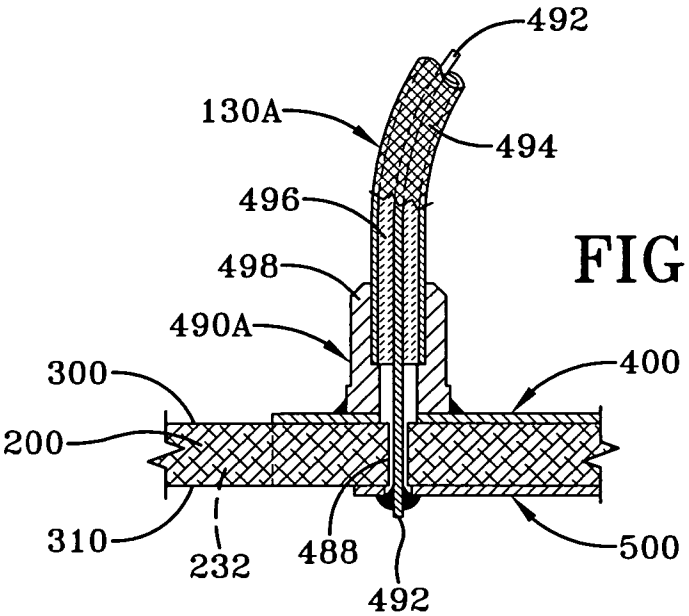
FIG. 6A is a cross-sectional view of a line connector maintained by each of the entry conics in accordance with the concepts of the present invention.
Figure 6:
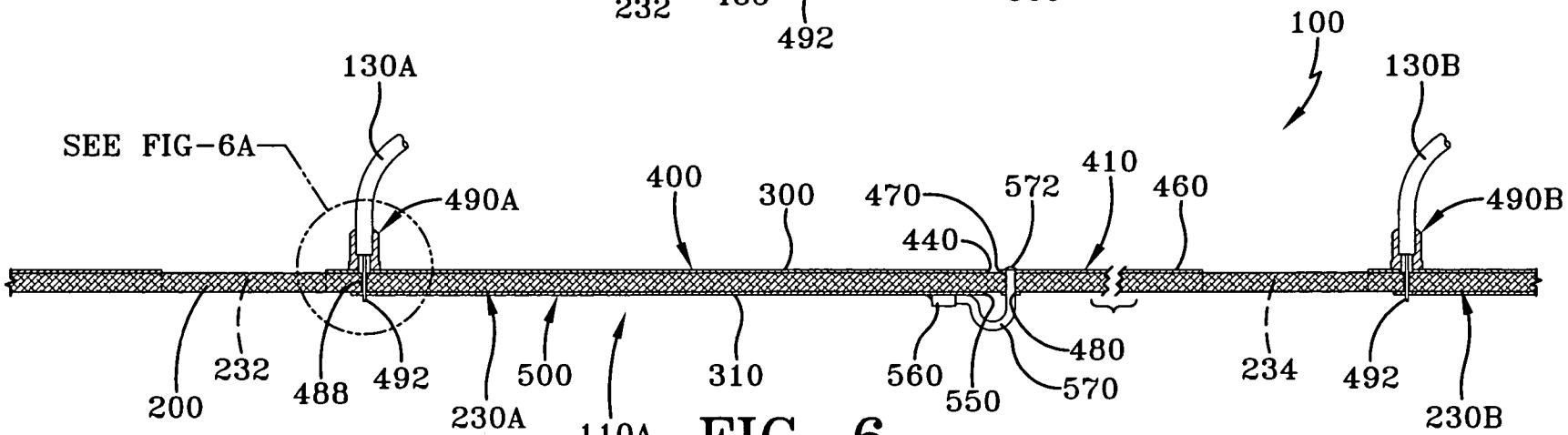
FIG. 6 is a cross-sectional view of a circuit board upon which the entry conic, the termination conic, and transmission lines are disposed in accordance with the concepts of the present invention.

To enable signals to be supplied to the antenna element section 230A via the feed line 130A, the substrate 200 provides a line aperture 488 extending therethrough, shown in detail in FIGS. 6 and 6A, extends between the conic side 300 and the transmission side 310 of the antenna element section 230A. A line connector 490A is aligned with the aperture 488 is electrically coupled to the entry conic 400, so that the feed line 130A may be electrically coupled thereto in a manner to be discussed. As shown in FIG. 6A, the feed line 130A comprises a coaxially arranged center conductor 492, and an outer conductor 494 that are separated by a non-conductive dielectric 496. It should be appreciated that the line connector 490A may comprise an SMA, BNC, or any other type of substrate-mountable connector that may be electrically coupled to the entry conic 400.

Figure 7:
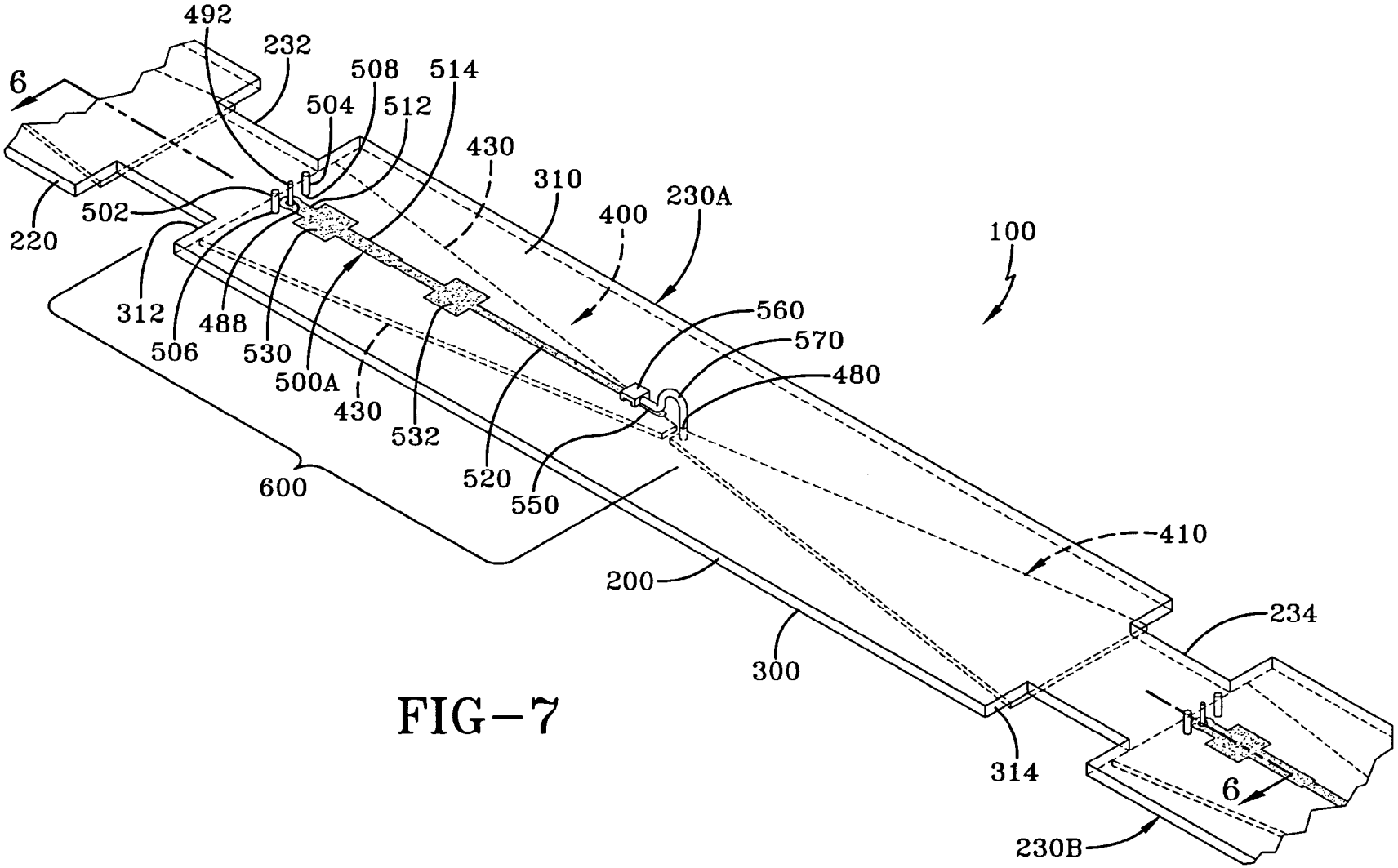
FIG. 7 is a perspective view of one of the transmission lines maintained by the biconical antenna system in accordance with the concepts of the present invention.

Continuing, the line connector 490A includes a conductive cable fixture 498 that is electrically coupled to the entry conic 400, and which retains and supports the feed line 130A. In addition, the cable fixture 498 also serves to electrically terminate the outer conductor 494 of the feed line 130A to the entry conic 400. Disposed within the fixture 498 is the dielectric 496 of the feed line 130A that electrically isolates the central conductor 492 of the feed line 130A from the line aperture 488. As best seen in FIGS. 6 and 7 a transmission line 500A is maintained by the transmission side 310 of the antenna element section 230A. Indeed, each antenna element section is provided with a corresponding transmission line. In one aspect, the center conductor 492 of the feed line 130A extends through the fixture 498 and the aperture 488 and is coupled to the transmission line 500A by any suitable coupling means, such as by a solder joint for example. It should be appreciated that the other end of the feed line 130A is configured to be selectively coupled to the signal splitter 120 in a manner to be discussed.

In addition, as shown in FIG. 7, the line connector 490A may also include a pair of support pins 502,504 that extend through support apertures 506 and 508 disposed upon either side of the line aperture 488, and which extend through the substrate 200 and the entry conic 400.

Referring now to FIGS. 4, 6, 6A and 7, it can be seen that the transmission side 310 of the antenna element section 230A includes the electrically conductive microstrip transmission line 500A. As previously discussed, the central conductor 492 of the feed line 130A passes through the line aperture 488 so as to be electrically coupled to the transmission line 500A by either a mechanical or soldered connection, such as the solder joint. The transmission line 500A, shown clearly in FIG. 7, includes a wide section 512, that extends from the line aperture 488 and which is contiguous with an intermediate section 514 and a narrow section 520 that extends toward the distal end 314 of the antenna element section 230A. Extending laterally from either side of the respective wide and narrow sections 512,520 are lateral sections 530 and 532. In one aspect, the lateral section 530 is proximate the line aperture 488, while the lateral section 532 is located distal the line aperture 488. It will be appreciated that the sections 512, 520, 530, and 532 may be shaped in any manner to create a matching transformer. It will also be appreciated that the lateral sections 530 and 532 are provided to compensate for the parasitic coupling between antenna elements 110A, 110B, and 110C via the helical feed system 134. It will further be appreciated that the microstrip transmission line 500A is centered within an envelope defined by the entry sides 430 of the entry conic 400. In other words, the triangle shape of the entry conic 400 is effectively bisected by the transmission line 500A. Accordingly, the transmission line 500A is disposed within a ground plane formed by the entry conic 400, and is essentially coaxially aligned with the entry conic 400.

Spaced apart from the end of the narrow section 520 is a conductive transmission pad 550. An inductor chip 560 is coupled between the narrow section 520 and the transmission pad 550. The inductor chip 560 is used in conjunction with the microstrip transmission line 500A to form a complete matching system, which will be discussed later. A wire loop 570 is configured, such that one end is connected to the transmission pad 550 by a soldered or a mechanical joint and the other end of the wire loop 570 is directed through the conic aperture 480 and electrically coupled to the termination conic 410 as shown in FIG. 6. The wire loop 570 allows for excitation of the respective antenna element 110 by transmitting energy from the microstrip/matching system. In other words, the center conductor of the coaxial feed line 130 that is mounted to the line connector 490A is coupled in series with the transmission line 500A, the inductor chip 560, and the wire loop 570, where it is electrically coupled to the vertex 470 of the termination conic 410.

It should also be appreciated that the wire loop 570 launches from the microstrip transmission line 500A to the termination conic 410 more effectively than antennas that utilize circuit board type via-pins that abruptly change direction before passing through the via, or aperture in the circuit board for connection to a portion of the antenna element, such as the conic section 410, for example. Additionally, the wire loop 570 also affords lower loss inductance to supplement the slightly higher Ohmic losses of the inductor chip 560.

The microstrip transmission line 500A, the transmission pad 550, the inductor chip 560 and the wire loop 570 collectively form a matching system 600, whereby the matching system 600 is positioned so that it is effectively "received" in the entry conic 400, although it is disposed on the other side of the substrate 200. It will be appreciated that the shape of the transmission line 500A controls the characteristic impedance attained by the matching system 600. As such, the transmission line 500A allows for precise tuning of the impedance of the matching system 600 so as to more effectively match the impedance of the feed lines 130A-C to achieve desired operational performance of the antenna 100.

The splitter section 210, as shown in FIGS. 8, 9, 9A, 10A and 10B, comprises a splitter side 650 and a termination side 652 that are joined by edges, wherein one end is a connector end 660 that is opposite a distal end 662. Disposed upon the termination side 652, shown in FIG. 3, is a termination layer 670 which functions effectively as a ground plane and which is comprised of a metallized layer of aluminum, tin, copper, or any other electrically conductive material. Whereas the splitter side 650 maintains the signal splitter 120 that is also formed as a metallized layer of aluminum, tin, copper, or any other electrically conductive material.

Figure 8:
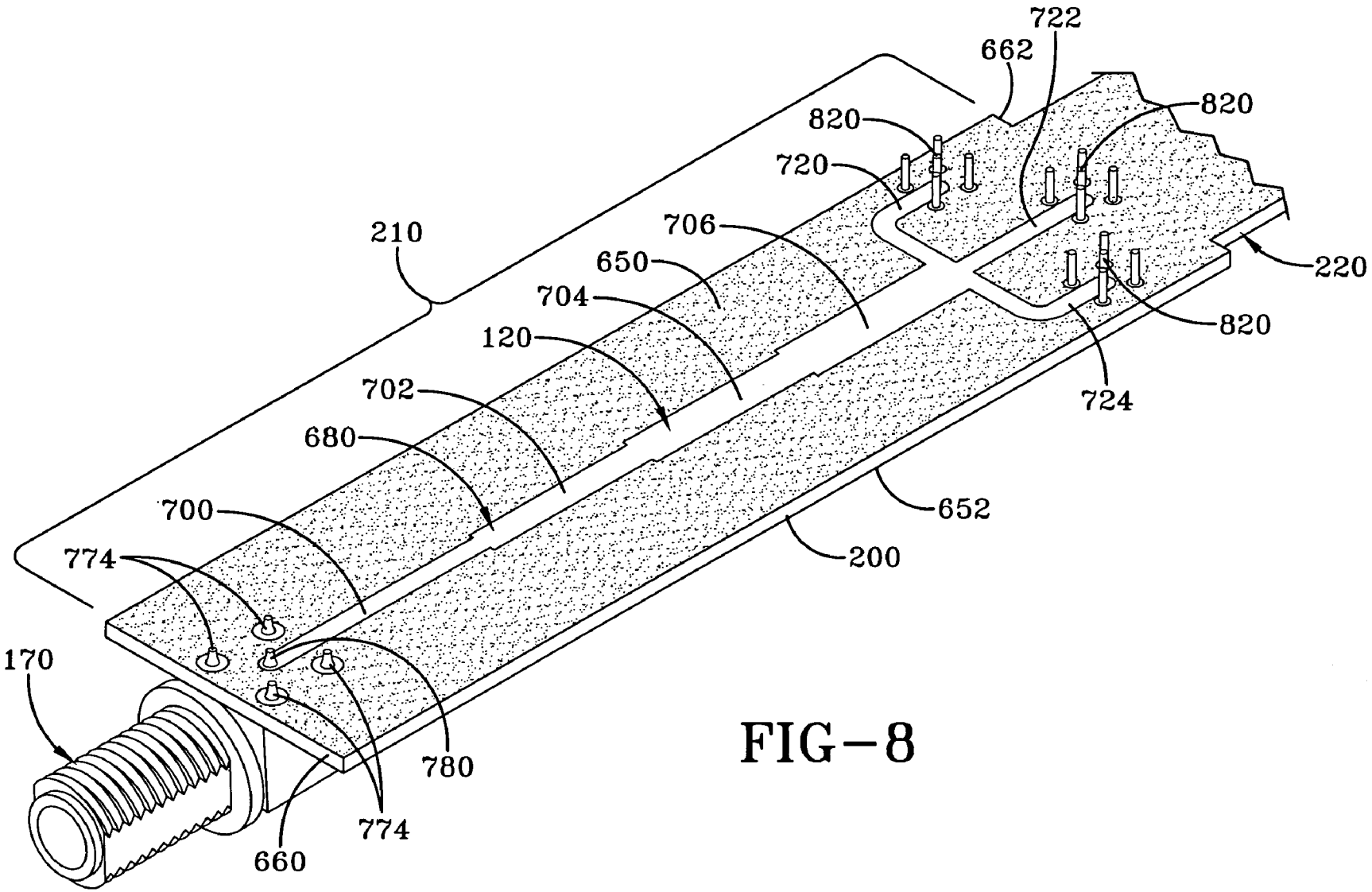
FIG. 8 is a perspective view of a signal splitter maintained by the biconical antenna system in accordance with the concepts of the present invention.
Figure 9:
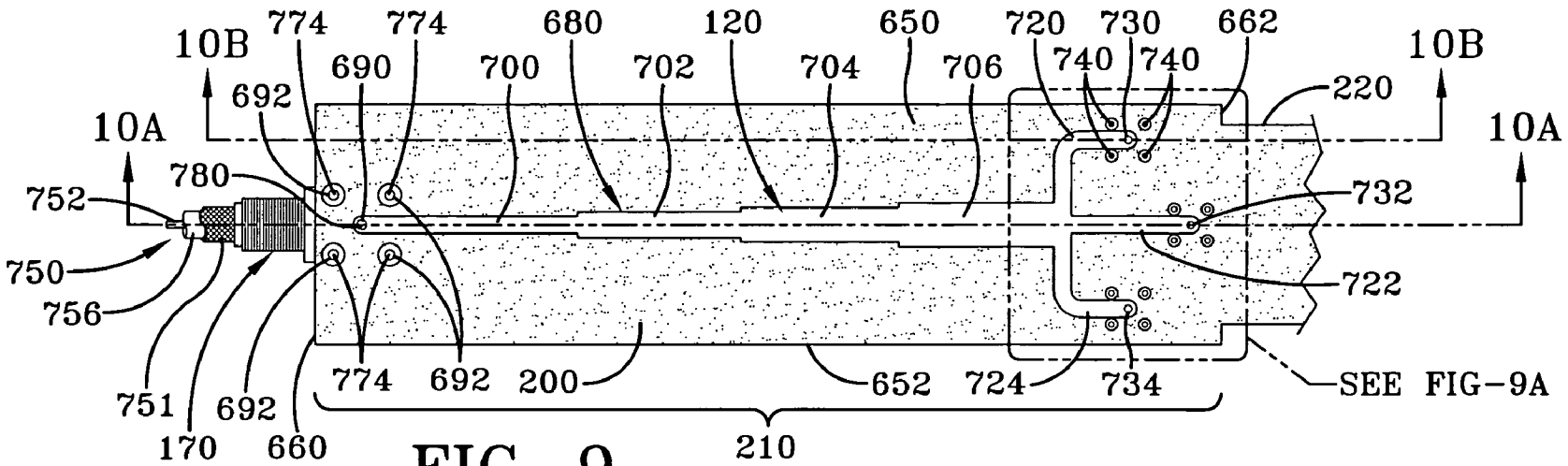
FIG. 9 is a plan view of the signal splitter in accordance with the concepts of the present invention.
Figure 9A:
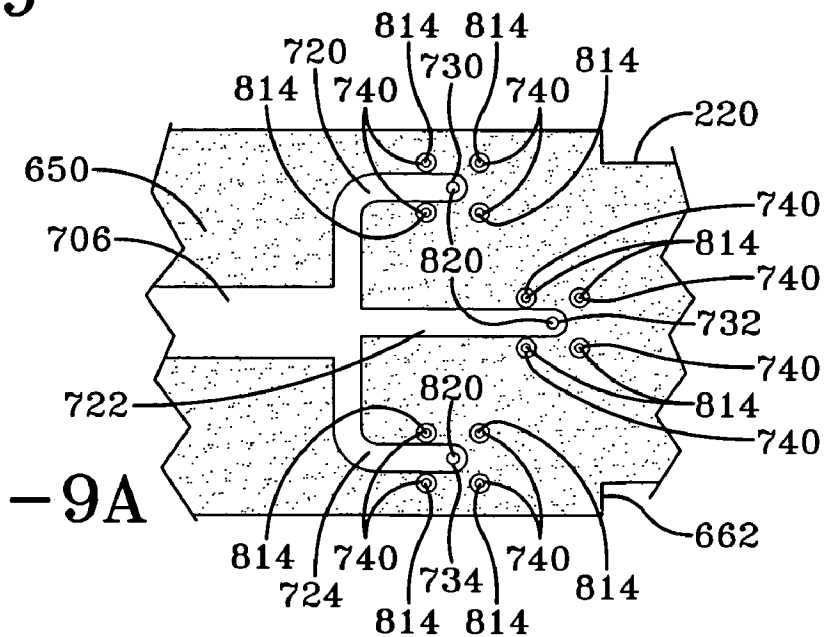
FIG. 9A is a top plan view of the various arms of the signal splitter in accordance with the concepts of the present invention.

As shown more clearly in FIGS. 8, 9, and 9A, the signal splitter 120 comprises a metallized input line 680 that extends from an input aperture 690 that is disposed through the termination layer 670, the substrate 200, and the metallized input line 680. In addition, a plurality of support apertures 692 may be arranged around the input aperture 690, and disposed through the termination layer 670 and the substrate 200. Moreover, the input line 680 is comprised of a plurality of progressively wider sections 700, 702, 704, and 706, whereby section 700 is the narrowest, and the section 706 is the widest. Extending from the widest input section 706 of the signal splitter 120 are a plurality of splitter arms 720, 722, and 724 that each terminate at respective output apertures 730, 732, and 734. The output apertures 730-734 are disposed through the metallized splitter arms 720, 722, 724, the substrate 200, as well as the metallized termination layer 670. Furthermore, arranged about each of the output apertures 730,732,734 are a plurality of support apertures 740 that only pass through the substrate 200 and the metallized termination layer 670. Although the outer splitter arms 720 and 724 are staggered from the central splitter arm 722, each arm has a substantially equivalent length.

Signals are supplied to the splitter section 210 via a transmission line cable 750 that is received by the input connector 170 that extends through the mounting flange 164. The transmission line cable 750 may comprise any suitable cable, such as coaxial cable or tri-axial cable for example. In one aspect, the transmission line cable 750 may include a center conductor 752, and an outer termination conductor 754 that are separated by a non-conductive dielectric 756. Moreover, it should be appreciated that the transmission line cable 750 is configured to be coupled at its other end to any suitable signal generator or transmitter. Additionally, the input connector 170 may comprise an SMA, BNC, or any other type of substrate-mountable connector that that is configured to be removably coupled to the transmission line cable 750.

Figure 10A:
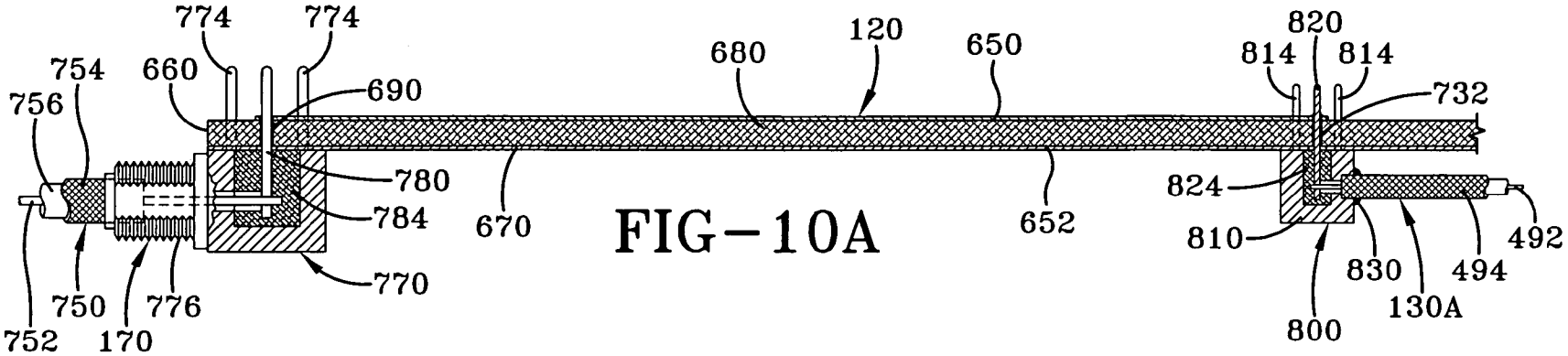
FIG. 10A is a cross-sectional view of the signal splitter taken along line 10A-10A in accordance with the concepts of the present invention.

Shown clearly in FIG. 10A, the input connector 170 comprises an electrically conductive body 770 from which extend various mounting pins 774. Within the body 770 is an input pin 780 that is electrically isolated from the body 770 by a non-conductive dielectric 784. Extending from the body 770 is a threaded receptacle 776 that is configured to receive an end of the transmission line cable 750. The input connector 170 is coupled to the splitter section 210, such that the mounting pins 774 extend through support apertures 692, while the input pin 780 extends through the input aperture 690. As such, the mounting pins 774 are not electrically coupled to the splitter 120, whereas the input pin 780 is electrically coupled to the splitter 120 via the input aperture 690. Thus, when the transmission line 750 is coupled to the input connector 170, the center conductor 752 is coupled to the input pin 780, which is thereby coupled to the input line 680 of the signal splitter 120. Whereas the outer termination conductor 754 of the transmission line cable 750 is coupled to the body 770, which is thereby coupled, or otherwise electrically terminated by the metallized termination layer 670. As such, the splitter receives any signals supplied to the antenna via the transmission line cable 750.

Furthermore, each of the arms 720,722,724 maintain respective output connectors 800, 802, and 804 that enable respective feed lines 130A, B, and C to be coupled thereto. With reference to FIGS. 9, 9A and 10A, the output connector 800 includes an electrically conductive body 810 that is electrically coupled to the termination layer 670. Extending from the conductive body 810 are various mounting pins 814. Within the body 810 is an output pin 820 that is electrically isolated from the body 810 by a dielectric 824. The body 810 also includes receptacle 830 that is configured to receive an end of the feed line 130A. The output connector 800 is coupled to the splitter section 210, such that the mounting pins 814 extend through the mounting apertures 740, while the output pin 820 extends through the output aperture 732. As such, the mounting pins 814 are not electrically coupled to the splitter section 210, and serve to provide support to the output connector 800, whereas the output pin 820 is electrically coupled to the arm 720. Thus, when the feed line 130A is coupled to the output connector 800 via the receptacle 830, the center conductor 492 of the feed line 130A is coupled to the output pin 820. Whereas the outer conductor 494 of the feed line 130A is coupled to the body 810 of the output connector 800, which is electrically coupled to the termination layer 670. As such, the signal supplied by the transmission line 750 is equally divided by the arms 720, 722, 724 before it is supplied to each of the respective antenna element sections 230A-C. Thus, the antenna 100 transmits a phase coherent signal independently of the frequency of the excitation signal supplied by the transmission line 750.

Figure 10B:
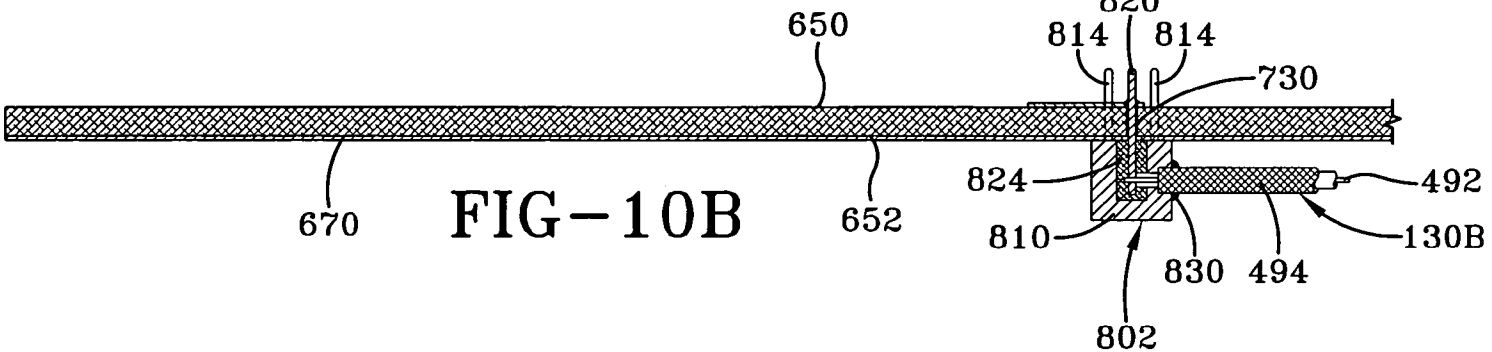
FIG. 10B is a cross-sectional view of the signal splitter taken along line 10B-10B in accordance with the concepts of the present invention.

Continuing, FIG. 10B shows the output connector 802, that is associated with the arm 720. However, it should be appreciated that the structure of the output connectors 802 and 804 are equivalent to that discussed above with regard to connector 800. As such, only the cross-section of output connector 802 is shown.

As shown in the FIGS., including FIGS. 11-14, the antenna element sections 230A, B, and C are disposed within respective retention sections 140A, 140B, and 140C of the helical feed system 134. The retention sections 140A-C serve to impart an amount of rigidity and support to the antenna element sections 230A, B, and C, and also provide helical support channels 150A-C within which the feed lines 130A-C may be helically arranged. Additionally, the retention sections 140A-C provide a protective enclosure to the various components comprising the antenna element sections 230A-C.

Figure 11:
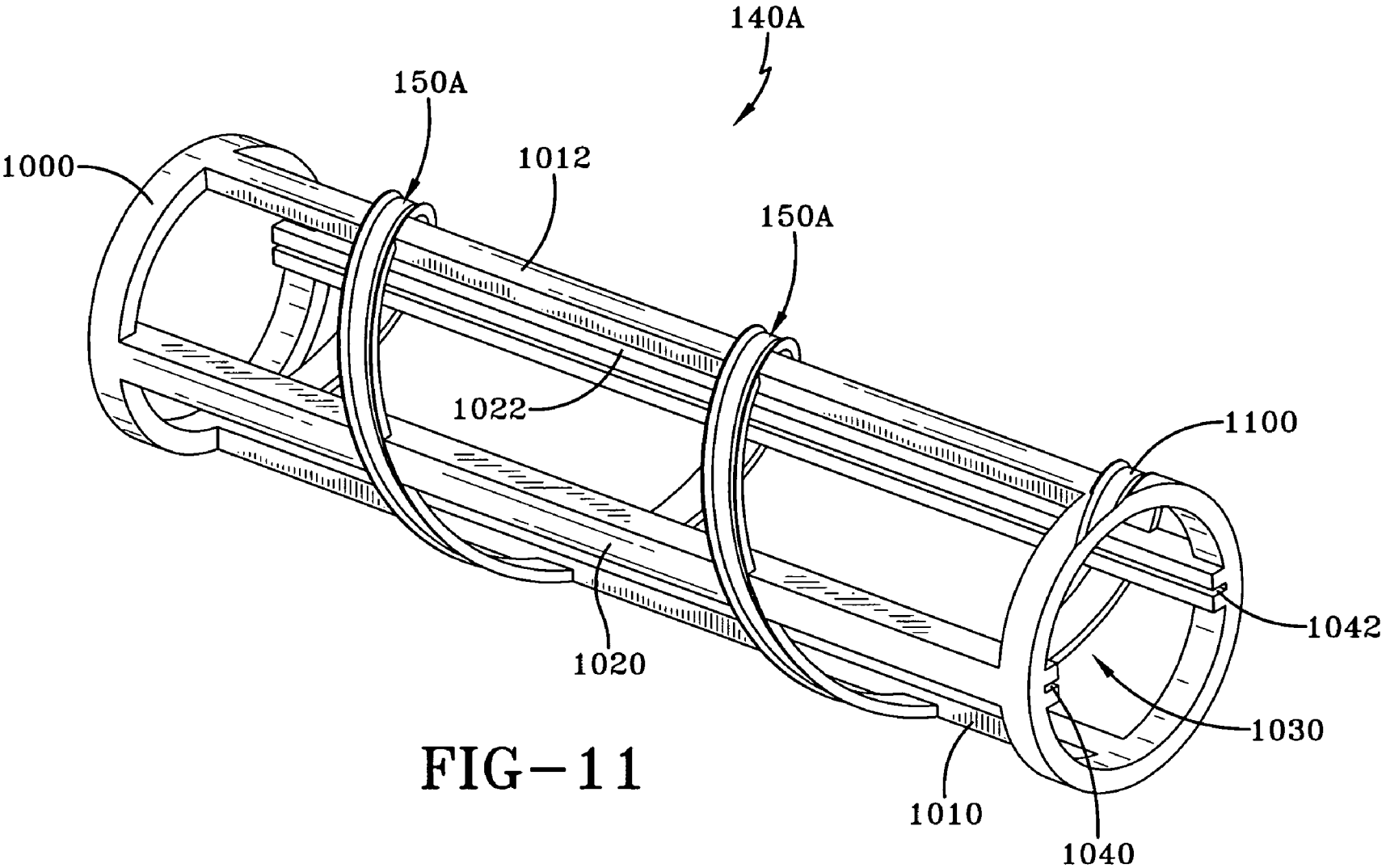
FIG. 11 is a perspective view of one of the retention sections used to retain one of the antenna element sections in accordance with the concepts of the present invention.
Figure 12:
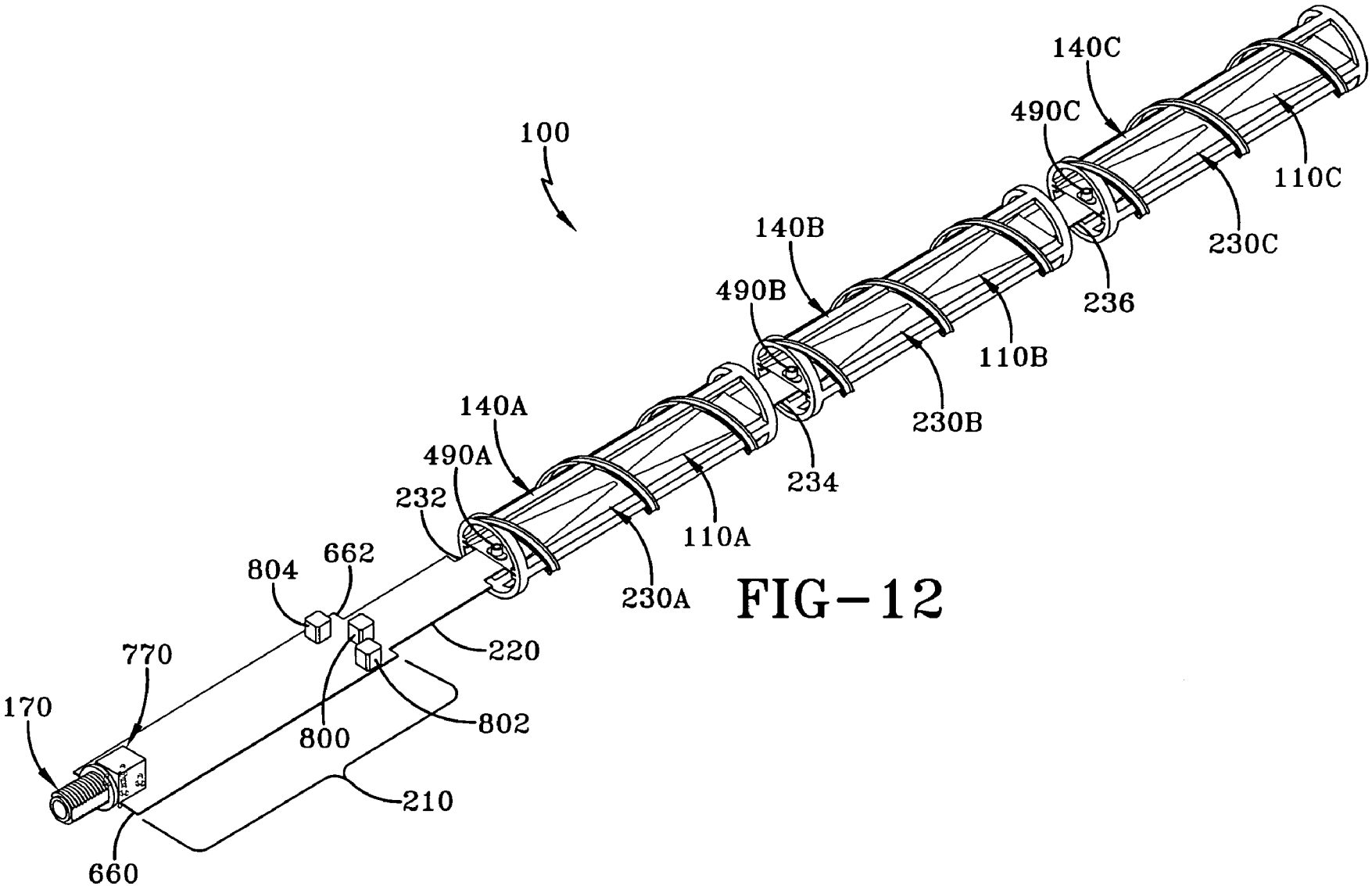
FIG. 12 is a perspective view of the biconical antenna system showing a plurality of retention sections each associated with a respective antenna element section in accordance with the concepts of the present invention.
Figure 13:
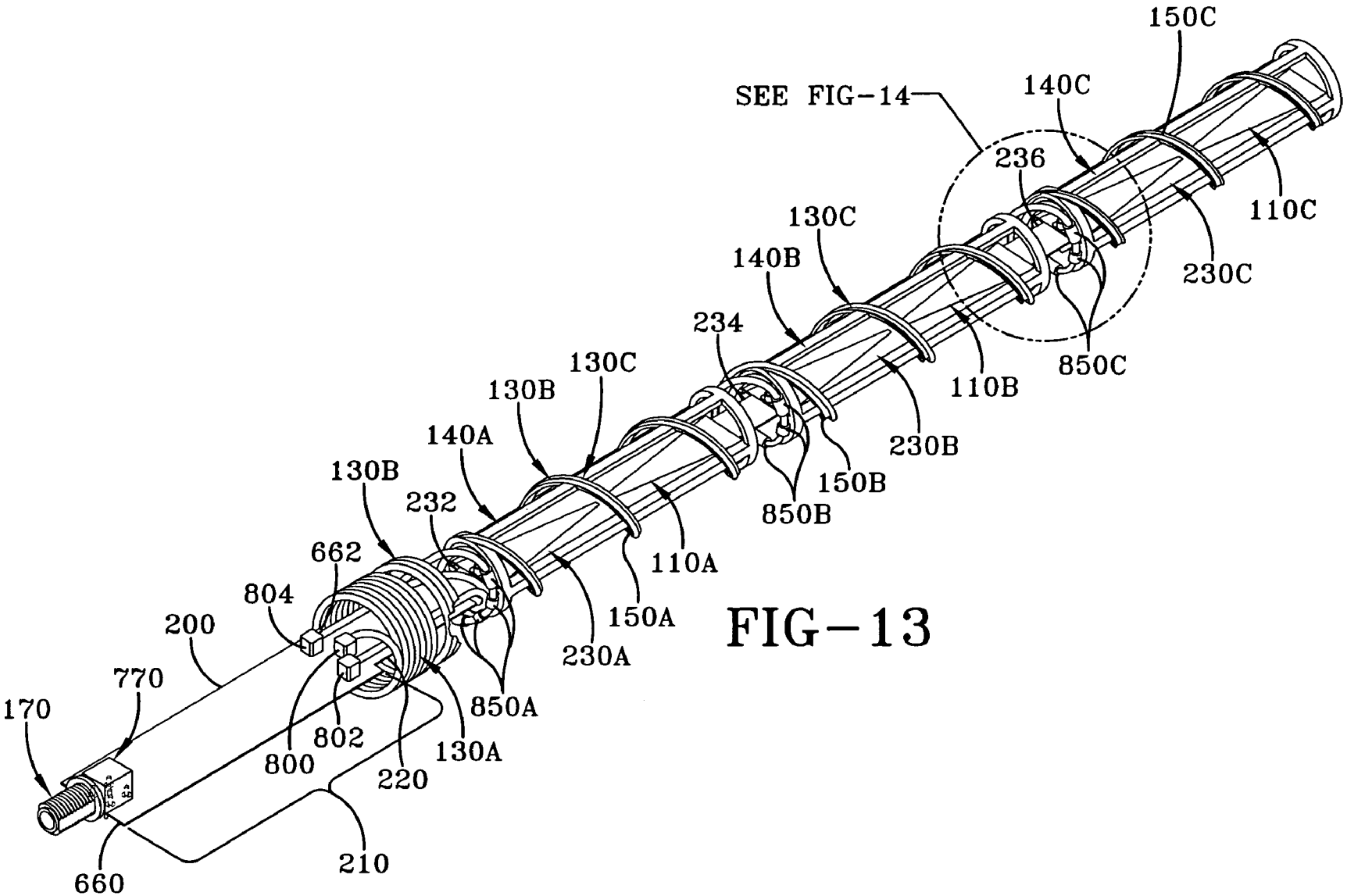
FIG. 13 is another perspective view of the biconical antenna system in accordance with the concepts of the present invention.
Figure 14:
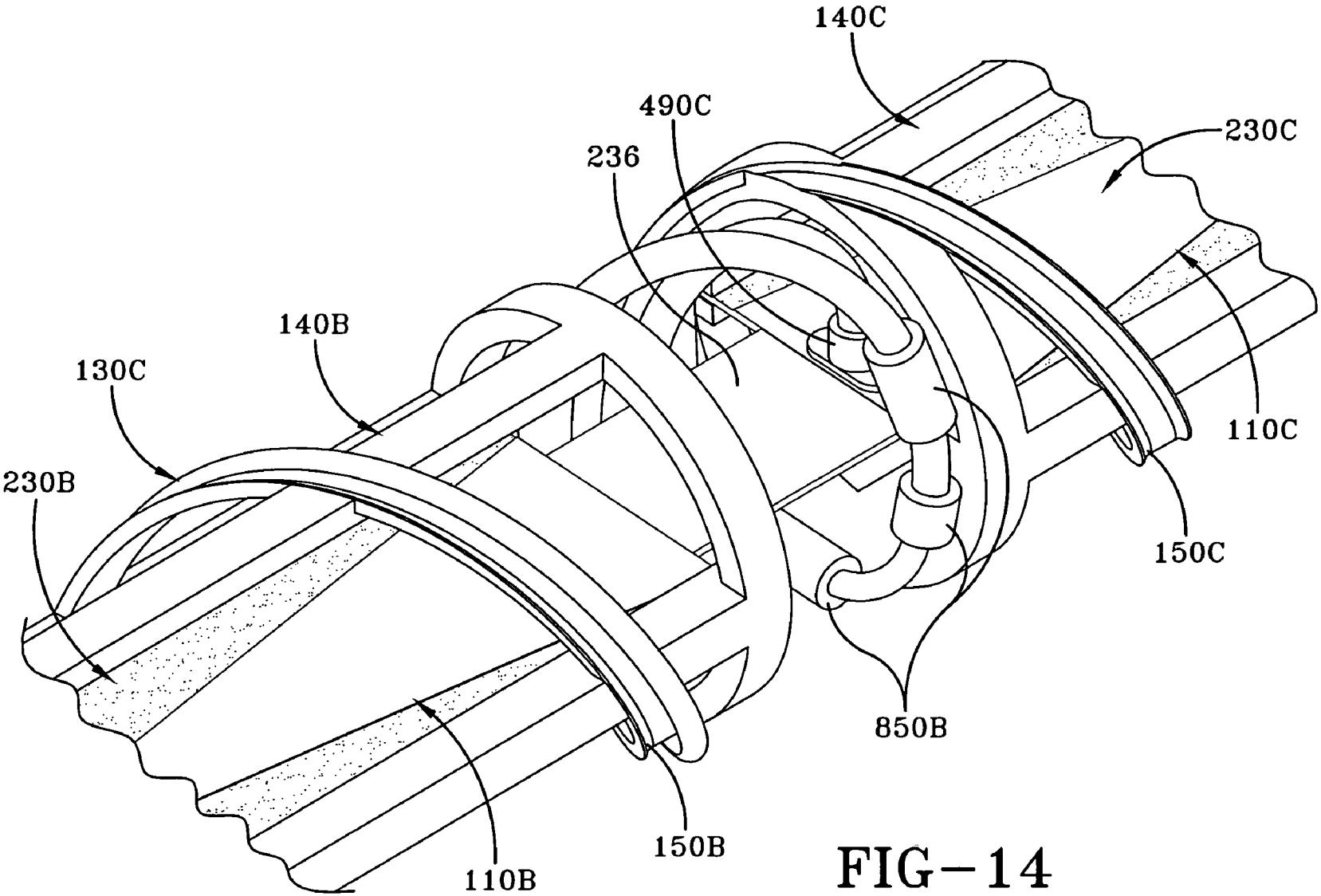
FIG. 14 is a perspective view of the biconical antenna system showing various isolation elements used to isolate each of the antenna element sections from one another in accordance with the concepts of the present invention.

Because the retention sections 140A, B, and C are structurally equivalent, the discussion that follows will be directed to only that of the retention section 140A. Specifically, as shown in FIG. 11 the retention section 140A is comprised of a pair of spaced ends 1000 and 1002, which are connected by a pair of support beams 1010 and 1012, and a pair of channel beams 1020, and 1022. The ends 1000 and 1002 may be circular in shape and have a rectangular cross-section, however, it should be appreciated that the ends 1000 and 1002 may be any suitable shape. Furthermore, the support beams 1010,1012, and the channel beams 1020,1022 may have a rectangular cross-section, however any desired cross-sectional shape may be used. The combination of the ends 1000, 1002 the support beams 1010,1012, and the channel beams 1020,1022 serve to form an inner cavity 1030. Disposed along the length of the channel beams 1020 and 1022 are respective channels 1040,1042. The cavity 1030 is dimensioned so that the circuit board 118 comprising the antenna element section 230A may be retained within the cavity, via the receiving channels 1040,1042. That is, the channels 1040, 1042 are configured to receive the edges 316,318 of the antenna element section 230A. Moreover, the channels 1040, 1042 are dimensioned so that the edges 316,318 are compressively fit therewithin, thus preventing the retention section 140A from moving. However, the edges 316,318 of the antenna element section 230A may be adhesively attached within the channels 1040,1042 if desired. It should be appreciated that the helical support channel 150A is attached to the support beams 1010,1012 and the channel beams 1020,1022 via any suitable method. Additionally, the ends 1000,1002 the support beams 1010,1012 and the channel beams 1020,1022 may be formed from any non-conductive material. Although the retention section is shown as a single-piece construction, it will be appreciated that the section could by split to facilitate assembly to the element section. It will also be appreciated that the retention section is constructed from a non-conductive material such as plastic.

Disposed about the outer perimeter of the retention section 140A is the helical support channel 150A that is configured to have a width and depth dimension that is suitable for retaining and supporting the feed lines 130B and 130C that are both disposed therein. In the case of the retention section 140B, the channel 150B retains only feed line 130C. Thus, when the feed lines 130B and 130C are disposed within the helical support channel 150A, the feed line 130B and 130C are conformed so as to follow the helical path established by the helical support channel 150A. Moreover, the channel 150C of the retention section 140C does not carry any of the feed lines 130A-C, and serves to support the antenna section 230C.

Thus, the antenna element sections 230A-C are respectively disposed within the retention sections 140A-C. The spacing section 232 serves to separate the antenna element section 230A from the support section 270. Whereas the spacing section 234, serves to separate the antenna element section 230B from antenna element section 230A, while spacing section 236 serves to separate the antenna element section 230C from antenna element section 230B.

In order to energize each of the antenna element sections 230A-C, each arm 720-724 of the splitter 120 is coupled via respective feed lines 130A-C to respective antenna element sections 230A, 230B, and 230C. In particular, the length of each of the feed lines 130A-C are substantially physically equal so as to allow the signals supplied to the antenna elements 230A-C to be phase aligned. The length of the feed lines 130A-C is determined by the longest physical distance between the output connectors 800,802,804 and the line connectors 490A-C associated with each of the respective antenna elements 230A-C. In the present embodiment, the largest length is feed line 130C. As such, the feed lines 130A-C are coupled at one end to the output connectors 800, 802, 804 of the splitter section 210 and the other end of the feed lines 130A-C are coupled to respective line connectors 490A-C maintained by each of the respective antenna elements sections 230A-C. In particular, feed line 130A is coupled at one end to the output connector 800 and is routed about the spacing section 232 and coupled to the line connector 490A. Similarly, feed line 130B is coupled at one end to the output connector 802 and is routed about the helical channel support 150A, then routed about spacing section 234 before the other end of the feed line 130B is coupled to the line connector 490B. Finally, feed line 130C is coupled at one end to the output connector 804 and is routed about the helical channel support 150A and 150B, then routed about the spacing section 236 before the other end of the feed line 130C is coupled to the line connector 490C. Skilled artisans will appreciate that the feed lines which are connected to antenna element sections 230A and 230B are coiled and wound about the support section 220. This winding along with the winding of the lines about the retention sections, provides a way to maintain equal lengths of the feed lines and provide optimal performance of the antenna.

It should be appreciated that the section of the feed lines 130A-C that are routed about the spacing sections 232, 234, and 236 may include respective isolation elements 850A, 850B, and 850C. The isolation elements 850A-C may be comprised of ferrite beads that include apertures 860 that allow the respective feed lines 130A-C to be received therethrough. Specifically, the isolation elements 850A-C serve to electrically isolate the antenna elements 110A-C from one another, and from the signal generator that is supplying signals to the antenna elements 110A-C via the feed lines 130A-C.

Therefore, based upon the foregoing, the advantages of the present invention are readily apparent, whereby a wide band biconical antenna array is configured to utilize a plurality of feed lines that are substantially the same length so that each of the signals received by the antenna elements have an equal amount of time delay. Another advantage of the present invention is that the wideband biconical antenna array is configured so that the feed lines are supported by a helical feed system so as to minimize the amount by which the signal transmitted by the antenna elements is attenuated. Still another advantage of the present invention is that the wideband biconical antenna array includes a plurality of coaxial antenna elements that enable the antenna array to be configured as a whip-type antenna with a narrow profile. And although three feed lines and antenna element sections are shown and described, it will be appreciated that any number of these components could be provided.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. An antenna for transmitting a signal from a signal source, comprising:

at least two feed lines;

at least two helical retention sections; and at least two coaxial antenna element sections configured to be respectively disposed within said helical retention sections, wherein each said feed line is connected to a corresponding one of said coaxial antenna element sections;

each said helical retention section comprising:

a pair of spaced ends;

a pair of opposed channel beams connected between said spaced ends, wherein said spaced ends and said channel beams form an interior volume in which a corresponding said antenna element section is disposed; and a helical support channel disposed about the periphery of said interior volume, wherein at least one of said feed lines is carried by said helical support channel.

2. The antenna of claim 1, wherein each said antenna element section comprises:

a conic side opposite a transmission side;

at least two effective conics disposed on said conic side and spaced apart from each other; and a transmission line disposed on said transmission side:

wherein said transmission line is disposed within a ground plane formed by one of the conics and wherein said transmission line is coupled at an end to one of the other of said conics.

3. The antenna of claim 2, wherein said at least two effective conics comprise:

an entry conic having an entry vertex; and a termination conic having a termination vertex, said conics axially aligned with each other, and said vertices having a vertex gap therebetween.

4. The antenna of claim 3, wherein said entry conic and said termination conic each have a half angle of about 9 degrees plus or minus 2 degrees.

5. The antenna of claim 3, further comprising a matching network coupled to said transmission line.

6. The antenna of claim 5, wherein said matching network comprises:

a conductive transmission pad spaced from said transmission line;

an inductor coupled between said transmission line and said transmission pad; and a wire loop coupled between said inductor and said termination conic.

7. The antenna of claim 6, wherein said wire loop is received through a conic aperture, said conic aperture disposed through said termination conic and said substrate.

8. The antenna of claim 5, wherein said matching network is disposed within said ground plane.

9. The antenna of claim 3, further comprising:

a signal splitter section positioned adjacent one of said antenna element sections, said splitter section having a splitter side opposite a termination side, said splitter side having a signal splitter disposed thereon configured to receive the signal from the signal source.

10. The antenna of claim 9, wherein said signal splitter comprises a plurality of arms, said signal splitter configured to split the power of the signal received from the signal source substantially equally among said arms.

11. The antenna of claim 10, wherein said feed lines having a center conductor, and an outer conductor separated by a dielectric, wherein said center conductor of each said feed line is coupled between one of said arms and said transmission line of each said antenna elements.

12. The antenna of claim 11, wherein said opposed channel beams include a receiving channel to receive an edge maintained by said antenna element sections.

13. The antenna of claim 12, wherein each said antenna element section is spaced apart from an adjacent antenna element section by a spacing section.

14. The antenna of claim 13, wherein the section of each said feed line passing about said spacing section carries one or more isolation elements.

15. The antenna of claim 14, wherein said isolation elements comprise ferrite beads.

* * * * *